United States Patent [19]

Rimbold

[11] 4,360,205

[45] Nov. 23, 1982

[54] BOARD GAME WITH PLAYER CLAIM BOARDS

[76] Inventor: James C. Rimbold, 365 Clark St., Saline, Mich. 48076

[21] Appl. No.: 161,892

[22] Filed: Jun. 23, 1980

[51] Int. Cl.[3] ..... A63F 3/00; A63F 3/04

[52] U.S. Cl. ..... 273/256

[58] Field of Search ..... 273/256, 250, 251, 252, 273/253, 254, 287

[56] References Cited

U.S. PATENT DOCUMENTS

| | | | |
|---|---|---|---|
| 2,026,082 | 12/1935 | Darrow | 273/256 |
| 2,458,966 | 1/1949 | Waldrop | 273/256 |
| 2,976,044 | 3/1961 | Corpening | 273/256 |
| 3,865,379 | 2/1975 | Breslaw | 273/256 X |
| 3,889,954 | 6/1975 | Malison | 273/256 |
| 4,052,072 | 10/1977 | Beal | 273/254 |
| 4,093,236 | 6/1978 | Hoffa | 273/255 |
| 4,114,891 | 9/1978 | Lawrimore | 273/250 |

*Primary Examiner*—Richard C. Pinkham
*Assistant Examiner*—Scott L. Brown
*Attorney, Agent, or Firm*—Harness, Dickey & Pierce

[57] ABSTRACT

A novel game apparatus and method of play which includes a game board and various playing elements. Players move playing tokens about the board to acquire real and tangible property, to earn income, and to try to abscond with property of other players without being caught. The objective of each player is to acquire sufficient wealth and power to challenge other players in order to acquire their money and/or control of their property. The course of the game is controlled by movement of player tokens about the board, subordinate games of chance, and two sets of cards which affect players property ownership and income.

8 Claims, 3 Drawing Figures

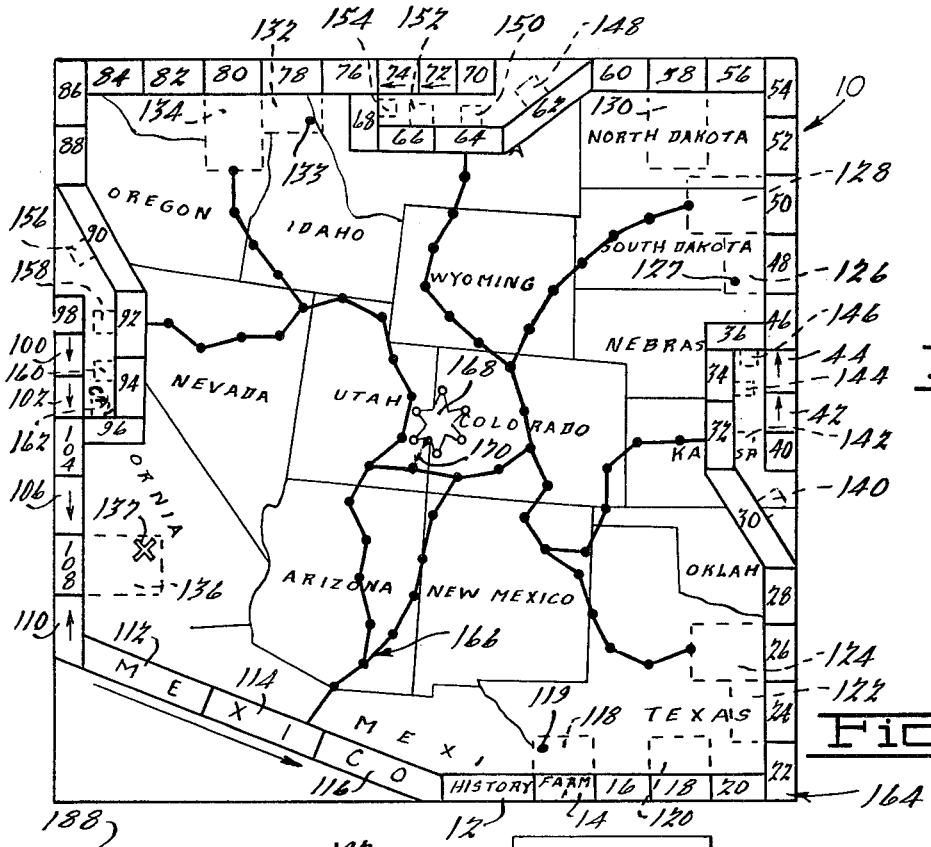
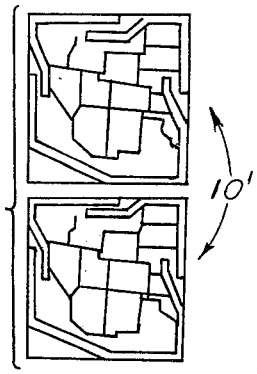
Fig. 1a.
Fig. 1.
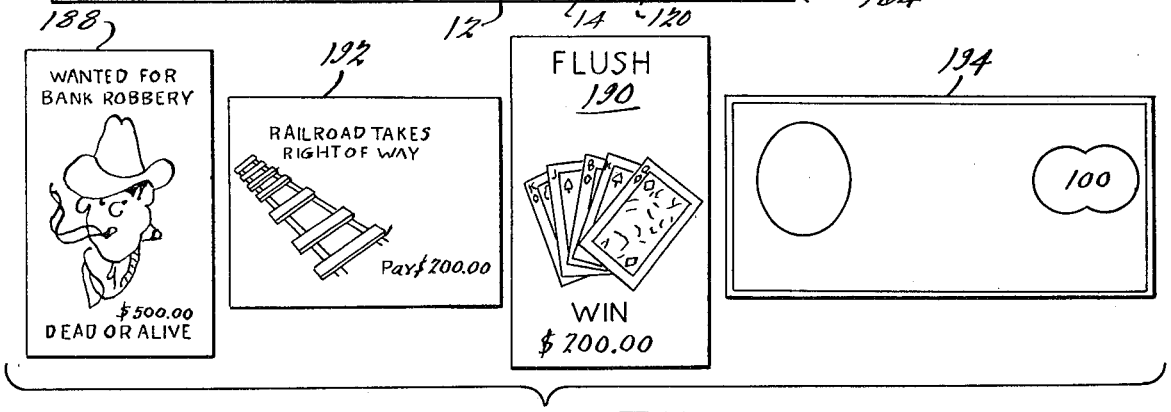
Fig. 2.
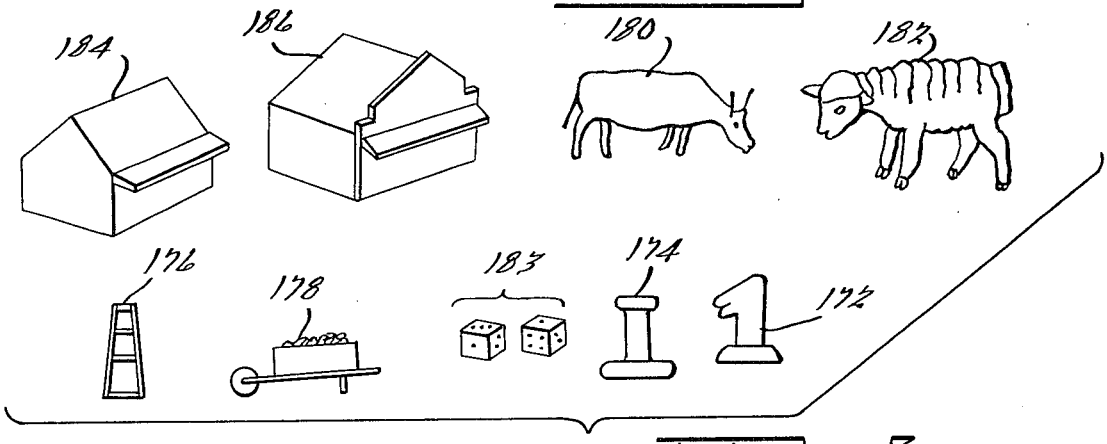
Fig. 3.

BOARD GAME WITH PLAYER CLAIM BOARDS

SUMMARY OF THE INVENTION

Generally speaking, the present invention relates to a method and apparatus for playing a game which includes a game board representative of a geographical area coonstituting the western portion of the United States and northern Mexico. The game board includes a series of spaces extending about its periphery which define a main trail or primary pathway along which player tokens are moved. Certain of these spaces, ownership of which can be acquired during the course of the game, represent farms, cattle ranches, a sheep ranch, towns and a gold field. Disposed within the interior of the main trail are a plurality of serpentine auxiliary pathways or outlaw trails which extend across the interior portion of the game board. These outlaw trails define entry points onto specific real property spaces along the main trail and connect with an escape area represented by a portion of the main trail which defines the Mexican boarder.

The apparatus constituting the invention also includes sets of tangible property tokens associated with particular real property spaces. Such tokens can be acquired by owners of such property spaces during the course of the game. Such tangible property tokens include large and small western buildings, cattle tokens and sheep tokens, as well as oil well and gold mine tokens which may be acquired by players owning particular properties having such natural resources thereon. The apparatus also includes two sets of pegs which players may acquire upon obtaining or controlling various real property spaces. These pegs are placed upon individual claim boards at appropriate locations to indicate such acquisition or control. The individual boards comprise miniature duplications of the game board and function to retain such pegs to indicate property ownership or control.

A first set of cards is included to allow players of the game to play a game of chance to earn income or acquire property or both. A second set of cards is included to depict various events transpiring in the western United States in the middle to late nineteenth century, and which require players to receive or forfeit money. Cards from either set are drawn when players land on specifically designated spaces along the main trail. The apparatus also includes a pair of dice for determining movement of from two to six player tokens along the main trail and outlaw trails, as well as play money sufficient to enable from two to six players to play the game. Other miscellaneous game pieces are described in the detailed description of the invention, set forth hereinafter.

The method of playing the game consists of players rolling dice and moving their player tokens about the board along either the main trail or the outlaw trails. Players may acquire farms, ranches, towns, oil rights and gold rights while moving about the main trail. Ownership of such properties allows players to earn income in diverse ways, such as by buying and selling cattle, buying and selling sheep, discovering oil and gold, acquiring banks, and by earning income when players either land or pass such owned property spaces. Additionally, players may rob banks and/or rustle cattle from other players by stealing money or cattle and moving them along the outlaw trails to the Mexico escape area. Other players may bounty hunt in an attempt to capture such bank robbers or rustlers in order to win rewards associated with their capture. Players landing on specifically designated power spaces along the main trail may attempt to exert political power against other players for money and/or control of the other players' property. The ultimate goal of all players is to earn sufficient income and property in order to either own or control all of the property on the game board which is owned. In all cases, the events transpiring during the course of the game are intended to represent particular occurrences taking place in the old west before the turn of the century.

It is accordingly a general object of the present invention to provide a new and improved game which includes a game board and plurality of playing pieces which are adapted to be moved by the various players of the game.

It is another object of the present invention to provide a new and improved game wherein as few as two and as many as six players can play.

It is still another object of the present invention to provide a new and improved game of the above type which simulates the environment and life style romantically associated with the old west in the middle to late nineteenth century and thereby acquaint players of the game therewith.

Other objects and advantages of the present invention will become apparent from the following detailed description taken in conjunction with the accompanying drawing.

BRIEF DESCRIPTION OF THE DRAWING

FIG. 1 illustrates a game board embodying the present invention;

FIG. 1(*a*) illustrates player claim boards used in the game of the present invention;

FIG. 2 is a schematic representation of a first plurality of playing pieces or elements which are used in connection with the game of the present invention; and FIG. 3 is a schematic representation of a second plurality of playing pieces or elements which are used in connection with the game of the present invention.

DETAILED DESCRIPTION OF THE PREFERRED EMBODIMENT

Referring now to the drawings, the novel game apparatus includes a game board or playing area of rectangular outline, shown generally at 10. The game board 10 may consist of a section of cardboard, cloth, leather or other structural material having a geographical map depicted on the central area thereof. As shown in FIG. 1, this map generally depicts the western portion of the United States with some of the more significant geographical points of interest indicated thereon, such as the borders and names of various states. Although not illustrated in FIG. 1, the map on game board 10 could also include significant mountain ranges, rivers, plains, desert areas, etc. Such geographical areas can be shaded in accordance with a standard geographical map.

The game board 10 includes a plurality of generally rectangular spaces disposed adjacent and extending generally along the rectangular perimeter of the game board 10. As shown in FIG. 1, these spaces are marked with numbers ranging from 12 to 116 as one moves in a direction counterclockwise about the perimeter of the game board 10. Each of these spaces includes printed matter therein, spaces 12 and 14 including such printed matter for exemplary purposes. Beginning with space 12 and moving generally counterclockwise about the rectangular periphery of the game board 10, these spaces contain the following printed matter therein: space 12 ("History"); space 14 ("Farm 1"); space 16 ("Advance To Nearest Poker Space"); space 18 ("Farm 2"); space 20 ("Move To First Unowned Property If You Wish"); space 22 ("History"); space 24 ("Farm 3"); space 26 ("Cattle Ranch 4"); space 28 ("Go To Gold Fields If You Wish"); space 30 ("Poker 5"); space 32 ("Bank"); space 34 ("Pay $b 20 For Room And Stable"); space 36 ("Supplies Pay $20"); space 40 ("Enter Jail Here"); spaces 42 and 44 ("Move One Space For Each Turn Missed"); space 46 ("Collect $50"); space 48 ("Farm 6"); space 50 ("Cattle Ranch 7"); space 52 ("History"); space 54 ("Advance To Political Power If You Wish"); space 56 ("Advance To Nearest Poker Space"); space 58 ("Sheep Ranch 8"); space 60 ("Add 1 to 5 To Your Next Turn"); space 62 ("Poker 9"); space 64 ("Bank"); space 66 ("Pay $20 For Room And Stable"); space 68 ("Supplies Pay $20"); space 70 ("Enter Jail Here"); spaces 72 and 74 ("Move One Space For Each Turn Missed"); space 76 ("Collect $50"); space 78 ("Farm 10"); space 80 ("Cattle Ranch 11"); space 82 ("Advance To Nearest Poker Space"); space 84 ("Political Power"); space 86 ("Political Power"); space 88 ("Political Power"); space 90 ("Poker 12"); space 92 ("Bank"); space 94 ("Pay $20 For Room And Stable"); space 96 ("Supplies Pay $20"); space 98 ("Enter Jail Here"); space 100 and 102 ("Move One Space For Each Turn Missed"); space 104 ("Collect $50"); space 106 ("Claim Jump Take $500"); space 108 ("Gold Fields 13"); space 110 ("Claim Jump Take $500"); spaces 112, 114, and 116 comprise three spaces with the word "Mexico" printed thereacross.

As shown in FIG. 1, the game board 10 also includes a plurality of rectangular spaces disposed adjacent specific property spaces about the game board 10 and defined by dotted lines. More specifically, the game board 10 includes a rectangular space 118 adjacent space 14 ("Farm 1"). Disposed within space 118 is a small circular area 119 having the printed material "Oil" therein. Moving about the game board 10 in a counterclockwise direction, the game board 10 also includes a rectangular space 120 adjacent space 18 ("Farm 2"), a rectangular space 122 adjacent space 24 ("Farm 3"), a rectangular space 124 adjacent space 26 ("Cattle Ranch 4"), a rectangular space 126 adjacent space 48 ("Farm 6"), a rectangular space 128 adjacent space 50 ("Cattle Ranch 7"), a rectangular space 130 adjacent space 58 ("Sheep Ranch 8"), a rectangular space 132 adjacent space 78 ("Farm 10"), a rectangular space 134 adjacent space 80 ("Cattle Ranch 11"), and a rectangular space 136 adjacent space 108 ("Gold Fields 13"). Disposed within rectangular spaces 126 and 132 are small circular areas 127 and 133, respectively, with each area having the printed material "Oil" disposed therein. Disposed within rectangular space 136 is an "X" 137, within which the word "Gold" is printed. These dotted rectangular spaces each define an area adjacent a property space within which various tangible property tokens may be placed by a property owner, as discussed more fully below.

The game board 10 also includes a series of smaller rectangular spaces or boxes disposed adjacent spaces 30 through 36. As shown specifically in FIG. 1, the game board 10 includes a box 140 adjacent space 30 within which the word "Saloon" is displayed. Adjacent space 32 is a box 142 within which the word "Bank" is displayed. Adjacent space 34 is a box 144 within which the word "Hotel" is displayed. A box 146 is disposed adjacent space 36 and contains the word "Store" therewithin. A similar set of rectangular spaces or boxes 148, 150, 152 and 154 are disposed adjacent spaces 62, 64, 66 and 68, respectively. These boxes 148 through 154 are likewise labeled as "Saloon", "Bank", "Hotel", and "Store", respectively. A similar set of boxes 156, 158, 160, and 162 are disposed adjacent spaces 90, 92, 94 and 96, respectively, and are similarly labeled "Saloon", "Bank", "Hotel", and "Store". Each of these boxes define a area adjacent a property space within which various tangible property tokens may be placed by a property owner, as discussed more fully below.

The previously described spaces and boxes comprise a main trail 164 upon which a portion of the game is played, as described more fully hereinafter. In addition to this main trail 164, the game board 10 includes a plurality of pathways defined by several series of lines and dots, which together form a plurality of generally serpentine outlaw trails 166 extending across the central portion of the game board 10 within the main trail 164. As shown most readily in FIG. 1, the game board 10 also includes a star-shaped badge 168 which is labeled "Start". Badge 168 defines the position from which the game is begun, as described below. The outlaw trails 166 define alternative courses of travel between the starting badge 168 and the several property destinations indicated in FIG. 1, as well as Mexico. Extending between badge 168 and the outlaw trails 166 is a broken line-arrow configuration 170, which indicates the direction in which players move from the starting position or badge 168 onto the outlaw trails 166 to begin the game. The purpose and function of these outlaw trails 166 will become apparent upon a reading of the description of the method for playing the game set forth hereinafter.

The game apparatus also includes a number of playing pieces, which are illustrated in FIGS. 2 and 3. More specifically, the apparatus is provided with six (6) player tokens which are moved by the players about the game board 10, one of which is indicated generally at 172. Each of these player tokens 172 is provided with the shape of a horse head, in conformance with the major theme of the western game. The game apparatus includes thirteen (13) claim markers or pegs 174, each of which is provided with a number which conforms to a piece of property indicated on the board (defined by spaces 14, 18, 24, 26, 30, 48, 50, 58, 62, 78, 80, 90, and 108). The claim pegs 174 are distributed to players upon purchase of these respective properties, as described more fully hereinafter. The game apparatus also includes a second set of thirteen (13) "control" markers or pegs of a shape similar to pegs 174. These "control" pegs 174 are provided in a specific color (such as white) to indicate their unique status and function. The game apparatus is also provided with three (3) oil well riggings 176, a wheelbarrow 178, nine (9) cattle tokens 180, three (3) sheep tokens 182, a set of dice 183, fifteen (15) small western buildings 184, six (6) large western buildings 186, and six (6) wanted posters 188. The purpose and function of each of these playing pieces will become apparent upon a reading of the description of the method for playing the game set forth below.

The game apparatus is also provided with sixteen (16) poker cards, one of which is illustrated at 190. Each of these poker cards 190 includes the word "Poker" displayed on one side. Fifteen (15) of these poker cards 190 include a representation of a poker playing hand on the opposite side, and printed matter which indicates a particular poker hand, as well as a dollar figure which is won or lost if that card is drawn by a player. More specifically, these fifteen (15) poker cards include the following poker hands and dollar figures won or lost displayed thereon: "Two Pair, Lose $100.00"; "Pair Of Sevens, Loss $100.00"; "Pair Of Tens, Lose $150.00"; "Pair Of Aces, Lose $150.00"; "Pair Of Queens, Lose $50.00"; "Pair Of Kings, Lose $100.00", "Three Nines, Lose $80.00"; "Three Jacks, Lose $100.00"; "Three Kings, Lose $200.00"; "Dead Man's Hand, Lose $200.00"; "Drew To Inside Straight, Lose $100.00"; "Full House, Win $200.00"; "Four Of A Kind, Win $200.00"; "Flush, Win $200.00"; "Royal Flush, Win $300.00". The sixteenth poker card 190 includes the following printed matter displayed thereon: "Caught Cheating, Thrown In Jail". The purpose and function of these poker cards 190 will also become apparent upon a reading of the method for playing the game set forth below.

The game apparatus additionally includes a set of sixteen (16) history cards, one of which is illustrated at 192. Each of these history cards 192 is labeled on one side with the word "History" and contains printed matter on its other side. More specifically, these history cards 192 contain the following printed matter thereon: "Railroad Takes Right Of Way, Pay $200.00"; "Indian Attack, Pay $200.00 For Damages" (2 cards); "Disease, Lose One Herd From Each Ranch You Own"; "Receive $150.00 For Selling Your Story To Eastern Newspaper"; "Bury Man Found Dead On Trail, Receive His $200.00 From Supply Box"; "Dust Storm, Pay $50.00 For Each Town, Farm, Or Ranch You Own"; "Fire, Pay $100.00 For Each Farm, Ranch Or Town You Own"; "Stampede, Lose One Herd From Each Ranch You Own"; "Held Up By Bandits, Pay $150.00"; "Blizzard, Pay $100.00 For Each Herd You Own And $100.00 For Each Farm You Own"; "Drought, Pay $100.00 For Each Farm You Own And Lose One Herd From Each Ranch You Own"; "Jail Break, Save To Escape From Jail"; "Cavalry Rescue, Save To Stop Indian Attacks"; "Governor's Amnesty, Save To Remove A Wanted Poster On You. Only After Reaching Mexico"; "Lynching, May Be Saved To Hang Wanted Man When Caught On Trail". The purpose and function of each of these history cards 192 will likewise become apparent upon a reading of the description set forth hereinafter.

The game apparatus also includes playing money sufficient for from two or six players to participate in the game, one piece of which is illustrated at 194. This money 194 is provided in denominations of 5, 10, 20, 100, 150 and 500 dollar figures. In keeping with the theme of the western game, the face of each piece of money 194 may be provided with script and detail indicating currency existing around the middle of the nineteenth century.

In accordance with the preferred form of the present game apparatus, the various spaces which comprise the main trail 164 are provided in various colors, depending upon the type of space involved. For example, the farm spaces 14, 18, 24, 48, and 78 ("Farm 1", "Farm 2", "Farm 3", "Farm 6", and "Farm 10", respectively) can be shaded in one particular color, such as tan. The ranch spaces 26, 50, 58, and 80 ("Cattle Ranch 4", "Cattle Ranch 7", "Sheep Ranch 8", and "Cattle Ranch 11", respectively) can be shaded in different color, such as green. On the other hand, the four spaces 30, 32, 34 and 36, which define a town property, can be shaded in yet another color, such as red. Similarly, spaces 62, 64, 66 and 68 can be shaded in the color red to indicate a second town. Likewise, spaces 90, 92, 94, and 96 can be shaded in red to indicate a third town. The gold fields space 108 can be shaded in yet another color, such as gold. Each of the preceding spaces comprises a type of property which can be acquired by individual players during the course of the game. The remaining spaces on the main trail 164 are non-property spaces and can be shaded in a neutral color, such as white. The six (6) player tokens 172 can be provided in six different shades of color to differentiate the token 172 possessed by each player. The six (6) wanted posters 188 can also be provided in shades which conform with the player tokens 172, so that a particular wanted poster 188 can be identified with a particular player.

The game apparatus also includes six (6) small player claim boards and a master claim board (not shown). Each of these boards effectively comprises a miniature duplication of the game board 10. Specifically, each of the smaller boards includes a miniature representation of a western states map, a main trail and a plurality of outlaw trails. These boards differ from the game board 10 in that the various farm, ranch, town and gold fields property spaces, along with their immediately adjacent dotted spaces and boxes, are depicted as solid covered blocks. For example, in the preferred form of the apparatus, spaces 14 and 118, which define "Farm 1", are depicted as a solid tan block. The remaining farm properties on these boards are also depicted as tan colored blocks. The four ranch properties are similarly depicted as green colored blocks, while the three towns and the gold fields property are depicted as red and gold colored blocks, respectively. The purpose of these smaller boards is to retain claim pegs 174 during the course of the game. More specifically, the master claim board serves the function of retaining the numbered claim pegs 174 of unowned properties, while the player claim boards serve to retain claim pegs 174 of properties acquired by the various players during the game. In either case, each claim peg 174 is placed on a property which is numbered in accordance with the claim peg 174, there being thirteen numbered properties and claim pegs 174. In the preferred form of the apparatus, the master claim board is bordered in black to distinguish it from the individual player claim boards.

The main object of the game is to acquire property, wealth and power during the course of the game, and to exert such power against other players. The game is won when one player owns or takes control of every property on the game board 10 that is owned. As illustrated in FIG. 1, the game board 10 generally comprises two kinds of trails, a main trail 164 and outlaw trails 166. The main trail 164 comprises the spaces around the outer rectangular periphery of the game board 10. Play on this main trail 164 moves in a counterclockwise direction around the game board 10, with the number of spaces moved equal to the total of two dice 183. However, a property owner (described below) may choose to use only part of his dice total in order to stop on any property owned by him. He then loses the remainder of his dice total. On main trail 164, a player can buy property, discover gold and oil, buy and sell cattle or sheep, earn farm income, and generally increase his wealth and power, as described more fully hereinafter. The outlaw trails 166, which are made up of the connected lines and dots on the interior portion of game board 10, are used to start the game, rob banks, rustle cattle or bounty hunt. Players moving on outlaw trails 166 may only roll one die 183 and move the number of dots equal to the total of this die 183. More than one player can be on the same dot on outlaw trails 166, or the spaces which make up the main trail 164, at the same time.

Before beginning the game, the players set up the game board 10 and place the stacks of poker cards 190 and history cards 192 face down within the reach of all players. The game box (not shown) is called the supply box and can be used to house all of the money 194, unowned properties and herds, and the master claim board. Each player is distributed $1,600 of money 194 from the supply box, chooses a claim board and a player token 172. The thirteen numbered claim pegs 174 are placed on the master claim board on the thirteen numbered properties indicated thereon. For example, the claim peg numbered "1" is placed on the tan colored block which represents "Farm 1", claim peg "2" is placed upon the tan colored block representing "Farm 2", and so on.

To initiate the game, the players place their player tokens 172 on the start badge 168, from where play begins. All players roll the two dice 183 and the first player to roll a number six (6) with the dice 183 is deemed the starting player. Play then proceeds from player to player counterclockwise about the game board 10. The starting player begins the game by rolling one die 183 and moving his player token 172 along the outlaw trail 166 of his choice. Each player then follows the same procedure by rolling one die 183 and moving along a given outlaw trail 166. As shown in FIG. 1, the various outlaw trails 166 define paths which lead to the main trail 164. The players traverse these outlaw trails 166 until they reach their destinations along main trail 164. The use of two dice 183 does not begin until the next turn after entering the main trail 164. Upon entry to the main trail 164, players may then proceed on each turn by rolling two dice 183 and moving their player tokens 172 counterclockwise around the main trail 164 a number of spaces which conforms to the total of the dice 183 on each roll.

In order to acquire property, a player must first land on either an unowned farm, ranch, or a poker space of a town. Therefore, in order to acquire a farm, a player must land on one of the farm spaces along the main trail 164: space 14 ("Farm 1"), space 18 ("Farm 2"), space 24 ("Farm 3"), space 48 ("Farm 6"), or space 78 ("Farm 10"). Upon landing on one of these farm spaces, the player may purchase the farm at a price of $200. This money is paid to the supply box and the player receives in return a small frontier building 184 to be placed upon the rectangular space adjacent the purchased farm property (space 118, 120, 122, 126 or 132). The player also receives a claim peg 174 which is numbered in accordance with the purchased farm property (1, 2, 3, 6 or 10). This claim peg 174 is taken from the master claim board and placed upon the player's own claim board on the appropriate farm space to indicate that the farm property has been purchased.

The same procedure is followed with respect to acquiring a ranch. To acquire a ranch, the player must first land upon one of the ranch spaces along the main trail 164 which defines a ranch property: space 26 ("Cattle Ranch 4"), space 50 ("Cattle Ranch 7"), space 58 ("Sheep Ranch 8"), or space 80 ("Cattle Ranch 11"). To purchase a ranch, the player pays $500 to the supply box in return for a small western building 184 and a numbered claim peg 174 (numbered in the case of ranches as 4, 7, 8 or 11). The small western building 184 is placed upon the rectangular space adjacent the purchased ranch property (space 124, 128, 130 or 134). A numbered claim peg 174 is taken from the master claim board and placed upon the player's own claim board on the appropriate ranch space to indicate that the ranch property has been purchased.

As previously indicated, the game board 10 includes three towns, each of which comprises four consecutive red colored spaces along the main trail 164. A player may acquire a town as a piece of property in the following manner. Using the town represented by spaces 30, 32, 34 and 36 as an example, a player landing on the poker space 30 of this town must draw a poker card 190 from the poker card stack. If the town is not owned by any player, poker is then played with the supply box. A winning poker hand gives the player ownership of the town if it is unowned. Upon drawing a winning card, the player collects his winnings (as indicated on the specific poker card 190), a numbered claim peg 174 from the master claim board to be placed upon his claim board at the corresponding town location (to indicate his ownership of the town), a large frontier building 186 to be placed upon the "Saloon" box of the town (in this case, box 140), and a small frontier building 184, which is placed upon the "Bank" box (in this case, box 142). When a poker player is trying to win a previously unowned town, he may purchase extra poker cards 190 from the supply box at $200 per draw. If a player lands on the poker space of a previously owned town, poker is then played with the town owner's money. In either case, if a poker player draws a losing poker card 190, he pays his loss to the supply box if the town is unowned, and to the town owner if the town is owned.

A player who owns property on the game board 10 can earn income during the course of the game. In connection with earning income from owned properties, players may use all or part of their dice totals to stop on their properties along the main trail 164. Upon so doing, a player will forfeit the remaining portion of his dice total. A player owning a farm property will receive $200 in income from the supply box for stopping on his own farm space. A player who owns a cattle ranch may, upon stopping on his ranch space, buy one to three cattle herds from the supply box at $200 per herd. The purchase of a herd will entitle the cattle ranch owner to place a cattle token 180 upon the space adjacent his cattle ranch (space 124, 128 or 134). Alternatively, upon stopping on his ranch space, a cattle ranch owner may sell herds back to the supply box at $1,000 per herd. A cattle ranch owner may possess only three cattle herds (i.e., three cattle tokens 180) at one time. The cattle ranch owner may not buy and sell herds on the same turn. If a sheep ranch owner stops on his sheep ranch (space 58), he may buy from one to three herds from the supply box at $100 per herd, or sell herds back to the supply box for $500 per herd. In this connection, herd ownership entitles the sheep ranch owner to place sheep tokens 182 upon the dotted rectangular space 130 in accordance with the number of herds owned. A sheep ranch owner is also entitled to collect $100 from each player landing on or passing his sheep ranch space. However, if a cattle rancher lands directly upon a sheep ranch owner's ranch space, the cattle rancher may refuse to pay the $100 to the sheep ranch owner and can return all of the sheep herds to the supply box.

A player who owns a town may not earn income until his town is completed. In order to complete a town, the town owner must purchase a store (small frontier building 184) to be placed upon the store box of the town (box 146, 154, or 162), and a hotel (large frontier building 186) to be placed upon the hotel box of the town (box 144, 152 or 160). These buildings may be purchased from the supply box at $150 each by the town owner at any time. A town owner earns income from a completed town by stopping on the bank space of his town (space 142, 150 or 158). Upon stopping on such a bank space, the town owner collects $100 from each player and the supply box. Moreover, $2,000 is deposited in the town owner's bank (the money is placed half-exposed under the game board 10 between the town limits). If the amount of money deposited in a town owner's bank equals or exceeds $4,000, the town owner instead receives $1,000 from the supply box, taking $500 for himself and placing $500 in deposit in the bank. A town owner cannot make withdrawals from his bank.

A farm owner may also earn additional income if his farm property is an oil property and he discovers oil thereon. In this connection, spaces 14 and 118 ("Farm 1"), spaces 48 and 126 ("Farm 6"), and spaces 78 and 132 ("Farm 10") are the oil properties on the game board 10. In order to discover oil, the farm owner must first stop on his oil property (collecting $200 for stopping on his farm, as indicated above). He may then search for oil by moving off the main trail 164 and onto the adjacent dotted rectangular space representing the oil property (space 118, 126 or 132). On his next turn, he then attempts to roll a six (6) with the dice 183. He may purchase as many attempts to discover oil as desired by paying $100 to the supply box for each roll of the dice 183. Upon rolling a six (6), the farm owner discovers oil. He then receives an oil well rigging 176 to be placed upon the oil marker (119, 127, or 133) of the property and collects $500 from the supply box. The farm owner will thereafter collect $300 from the supply box each time he passes this property. If the farm owner happens to land upon his farm property with an oil well rigging 176 thereon, he collects $500 from the supply box. If the farm owner is unsuccessful in his attempt to discover oil, he may stop his search at any time by moving from the oil property back onto the main trail 164 and advancing on his next turn. On the other hand, if the farm owner rolls a six (6) while on the main trail 164 on his farm property space (space 14, 48 or 78), he is deemed to have accidentally discovered oil and is paid income according to the rules set forth above.

Income can also be earned by any player who discovers gold. In order to discover gold, a player must land on the gold fields space 108. The player may search for gold by moving off the main trail 164 and onto the dotted rectangular space 136 which represents the gold fields property. On his next turn, this player can discover gold by rolling a six (6) with the dice 183. The player may purchase as many attempts to roll a number six (6) as desired, by paying $100 to the supply box for each roll of the dice 183. When a player discovers gold, he collects $1,000 from the supply box. He also receives a wheelbarrow 178 to be placed upon space 136 over gold marker 137 to indicate that the property is presently owned, and a numbered claim peg 174 from the master claim board to be placed upon his own claim board. Moreover, $5,000 in $500 bills are taken from the supply box and placed half-exposed under the gold fields space 108. The gold fields owner will collect $500 from this space each time he passes it. When all of the gold money has been collected, the owner's claim peg 174 is returned to the master claim board in the supply box. Gold can thereafter be discovered by any player who lands on the gold fields space 108 and attempts to discover gold. If a player is unsuccessful in his attempt to discover gold, he may stop his search at any time by moving from space 136 back onto the main trail 164 and advancing on the next turn. If a player rolls a six (6) while stopped on the gold fields space 108, he is deemed to have accidentally discovered gold and is entitled to earn income according to the rules set forth above.

As illustrated in FIG. 1, the game board 10 includes two claim jump spaces 106 and 110 on either side of the gold fields space 108. Any player, other than an owner of the gold fields, who lands upon a claim jump space is entitled to take $500 from the gold fields space when it is owned. If this player lands on both claim jump spaces in successive turns, he then becomes the new owner of the gold fields. He then receives a numbered claim peg 174 for his claim board, and receives another $500 from the gold field space 108 by reason of landing on the second claim jump space 110.

Income can also be earned or lost by operation of the poker cards 190 and the history cards 192. The operation of the poker cards 190 has been previously discussed. With respect to the history cards 192, a player must draw a history card 192 from the stack of history cards each time he lands upon a history space along the main trail 164 (space 12, 22 or 52). Upon drawing a history card 192, the player is obligated to follow the directions indicated thereon. As indicated above, 10 of these cards 192 will require the player to either pay or receive an amount of money by reason of the event described on the card. Two of the cards 192 will require a property owner to forfeit herds, which will indirectly affect the owner's ability to earn future income. The remaining four cards 192 are cards which maybe saved for future use: to remove a wanted poster; to escape from jail; to stop an indian attack (which otherwise would require the loss of money); or to lynch a captured outlaw.

When a player runs short of money so that he cannot cover losses, he may sell his properties and herds back to the supply box at cost. For example, farms may be sold for $200, ranches for $500, cattle herds for $200 per herd, and sheep herds for $100 per herd. Town property can be sold back to the supply box for $300 per town. When property is sold back to the supply box, the player loses any attendant oil rights, and all buildings, money 194 and claim pegs 174, etc., are returned to the supply box. If a player sells all of his property and still cannot pay losses, he is obligated to move to the closest jail, entry being accomplished by moving his player token 172 to one of the "Enter Jail Here" spaces (space 40, 70, or 98). Such a player then loses three turns, and moves one space forward for each turned missed. Using the jail represented by space 40, a jailed player would therefore move to spaces 42, 44 and 46 upon his next three turns. Upon landing on space 46, this player will collect $50 from the supply box and advance normally on his next turn.

Another aspect of the game relates to robbers, rustlers, and bounty hunters. This aspect of the game is played upon the plurality of outlaw trails 166 disposed in the central portion of the game board 10. It involves attempts to steal cattle tokens 180 or money 194 from the various cattle ranches and town banks situated around the main trail 164 of the game board 10 and moving them along the outlaw trails 166 to an escape area represented by Mexico (space 114). If an outlaw robs a bank, he is entitled to keep all of the stolen money upon reaching Mexico. If he is a cattle rustler, his goal is to move the cattle herds he has rustled along the outlaw trails 166 to Mexico. Upon reaching Mexico, the rustled herds are sold to the supply box for $500 per herd.

Any player may become a robber or rustler when he passes or lands upon any of the property spaces along the main trail 164 which represent cattle ranches having cattle herds thereon or the three banks. Such properties are those indicated on the game board 10 as having an entry onto the outlaw trails 166: "Cattle Ranch 4" (spaces 26 and 124); "Cattle Ranch 7" (spaces 50 and 128); "Cattle Ranch 11" (spaces 80 and 134); and the three banks (spaces 32, 64 and 92). A player deciding to become a robber or rustler moves his player token 172 two dots onto the outlaw trail 166 which enters the property in question. If a player decides to become a bank robber, he takes the money deposited within the bank in question and places it beside the supply box, along with a wanted poster 188 of the same color as his player token 172. In this connection, it should be noted that the game apparatus includes six (6) wanted posters 188, each of which is of a color which conforms to a particular player token 172. If one becomes a cattle rustler, no wanted poster is posted.

At this point, all other play on the game board 10 is discontinued until the robber or rustler either has escaped or is captured. All other players, except those residing in a jail (spaces 40, 70 or 98), must then decide whether or not to become "bounty hunters"—those who chase the robber or rustler in an attempt to capture him. Upon either the escape or capture of a robber or a rustler, as described more fully hereinafter, regular play on the game board 10 may be continued with the player sitting to the left of the robber or rustler. If no players decide to become bounty hunters, the robber or rustler is deemed to have automatically escaped. He may therefore move along the outlaw trails 166 directly to Mexico space 114.

Those who decide to become bounty hunters move their player tokens 172 one dot off the main trail 164 and onto the outlaw trail 166 behind the robber or rustler. Players already on the outlaw trails 166 must move either one dot off the main trail 164 behind the robber or rustler, or to the first Mexico space 112 of main trail 164 if they choose not to become bounty hunters. Players residing on the main trail 164 who decide not to become bounty hunters are obligated to remain where they are.

The bounty hunt begins with the robber or rustler rolling one die 183 and moving his player token 172 along the outlaw trail 166 a number of dots equal to the roll of the die 183. The bounty hunters thereafter follow in turn, each rolling one die 183 and moving their player tokens 172 accordingly. If a bounty hunter rolls a number high enough to land on or pass the robber or rustler, he stops beside that player and calls for a shoot-out. To conduct a shoot-out, the bounty hunter and the robber or rustler each roll two dice 183. The player rolling the highest total wins the shoot-out. Equal totals constitute a tie and require the dice 183 to be rolled again. If the outlaw wins the shoot-out, he moves his player token 172 one dot forward and the bounty hunt continues. If the outlaw loses the shoot-out, he is deemed to be captured.

After losing a shoot-out, a robber or rustler is sent either to the jail in the last town he robbed, or to the jail in the town which is closest to the last ranch he rustled. The bounty hunter who has captured a robber or rustler moves to the "Bank" space of the same town. All unsuccessful bounty hunters move their player tokens 172 to the start badge 168. In the case of a bank robbery, a successful bounty hunter collects a $500 reward from the supply box for capturing the bank robber and returning the bank money. When a cattle rustler is captured, the successful bounty hunter collects a $200 reward from the cattle ranch owner for each returned herd. If the ranch owner does not have enough money to pay such a reward, he may sell one of his herds for $1,000 and pay the reward to the successful bounty hunter.

As previously indicated, one of the history cards 192 comprises a "Lynch" card. A player who draws the "Lynch" card may either return it to the history card deck or save it until he becomes a successful bounty hunter to lynch a captured robber or rustler. If the bounty hunter lynches an outlaw, he moves his player token 172 to the appropriate "Bank" space to collect his reward. The lynched outlaw moves his player token 172 to the start badge 168, and returns all of his money and property to the supply box. The outlaw receives $600 to begin the game as a new player upon his next turn. An outlaw can only be lynched if he is captured on an outlaw trail 166. In other words, a player possessing the "Lynch" card may use it only upon the outlaw trails 166.

It should be noted that once a cattle rustler escapes to Mexico, he is beyond jeopardy and can continue play along the main trail 164 without worry. However, a bank robber who escapes to Mexico must place his wanted poster 188 upon a display stand (not shown), and is thereafter considered a "wanted man". This wanted poster 188 will be removed from the display stand only when the wanted man is captured or sent to jail for any reason. While the wanted man is entitled to keep all bank money he has stolen, any other player may call for a shoot-out with the wanted man if the two players happen to be on the same space along the main trail 164 at the same time. If this player loses the shoot-out with the wanted man, he must pay $100 to the supply box for medical expenses. Both this player and the wanted man will thereafter advance on their next turns. If the wanted man loses the shoot-out, he is captured and sent to jail in the town whose bank he robbed.

As noted in the preceding description, the main trail 164 includes a number of non-property spaces. A player landing upon such spaces will be obligated to follow the directions indicated by the printed matter therein. For example, spaces 12, 22 and 52 are "History" spaces. A player landing upon these spaces is obligated to draw a "History" card 192 from the history card deck and follow the directions indicated thereon. Certain other non-property spaces along the main trail 164 will require a player landing thereon to move his player token 172 in accordance with the directions indicated in the spaces. These spaces include space 16 ("Advance To Nearest Poker Space"), space 20 ("Move To First Unowned Property If You Wish"), space 28 ("Go To Gold Fields If You Wish"), space 54 ("Advance To Political Power If You Wish"), space 56 ("Advance To Nearest Poker Space"), space 60 ("Add 1 To 5 To Your Next Turn"), and space 82 ("Advance To Nearest Poker Space").

Three of the spaces along the main trail 164 (spaces 84, 86 and 88) comprise "Political Power" spaces. A player landing upon any of these three spaces has the option to exert political power to take control of property owned by other players in the following manner. If a player decides to exert political power, all other play on the game board 10 must stop. The power player thereupon pays $2,000 to the supply box, places $3,000 on the game board 10, and names a player against whom he desires to exert his power. The named player must then place $3,000 upon the game board 10. If the named player possesses less than this figure, he must place all of his money on the game board 10. The power player and the named player then roll two dice 183. The player rolling the highest total wins all of the money placed upon the game board 10. The power player also wins if both players happen to tie, or if the power player rolls a six (6). Prior to rolling the dice 183, either player may increase the amount of money on the game board 10 by $1,000 amounts as often as desired. The named player must match the money increases of the power player, or place what money he has left on the game board 10. However, the power player does not have to match money increases of the named player. In this connection, the named player will earn one extra point which he can add to the total of his dice throw for each $1,000 increase that the power player does not match. However, the total points of a named player (his dice throw plus his extra points) cannot exceed 12. If a power player loses, he must advance on his next turn. This player can again attempt to exert political power whenever he lands upon a "Political Power" space.

Each time a power player wins a power play, he has the option of again attempting to exert political power against the same or any other player on the game board 10. If he exercises this option, the power player must place $3,000 on the game board 10, but he does not have to pay an additional $2,000 to the supply box. If a power player wins all of a named player's money, the power player "controls" the named player. At this point, the power player receives a white "control" peg 174 from the supply box for each property owned by the controlled player. The power player places these "control" pegs 174 on his own claim board in accordance with the property locations of the controlled player. The power player is also entitled to receive any "control" pegs 174 possessed by the controlled player. In exchange, the power player must tender $600 to the controlled player. A player possessing "control" pegs 174 for another player's property is called a "controller". If a controlled player has to sell his own properties in order to pay losses, his controller has the option to buy such property at cost before it is sold back to the supply box. If the controlled player acquires new property, or discovers gold, his controller receives a "control" peg 174 for that property. A player can have only one controller. Therefore, once a player is controlled, any other player can exert political power against a controlled player for the latter's money only.

A controlled player may continue to play and earn money in an attempt to win back control of his property, and can attempt to do so if he lands on a "Political Power" space. In this connection, the controlled player must use political power against his controller before he can exert it against other players. In an attempt by a controlled player to exert political power, the controlled player must pay $5,000 to the supply box (instead of $2,000), and can win only upon rolling a six (6) or on a high roll. The controlled player and his controller must roll again if they happen to tie.

As suggested above, control of owned properties may change during the course of political power players. The game is won when a player possesses on his own claim board either a claim peg 174 or a "control" peg 174 for every property that is owned on the board. Unowned property is considered irrelevant for this purpose.

It is understood that the foregoing description is that of the preferred embodiment of the game board apparatus of the present invention and that various changes and modifications may be made thereto without departing from the spirit and scope of the invention, as defined in the appended claims.

What is claimed is:

1. A game board apparatus comprising a game board having means depicting a series of marked spaces defining a primary pathway extending in a closed loop about said game board, certain of said marked spaces along said primary pathway being designated as real property spaces, a set of tangible property tokens, certain of said tangible property tokens being associated with certain of said real property spaces to represent tangible property associated with such real property spaces, two or more movable player tokens, each said player token being dedicated to a different player, and movement means for determining the movement of said player tokens about said game board, whereby players are entitled to acquire property and earn income while moving their player tokens about said primary pathway by acquiring ownership of particular real property spaces and purchasing and selling tangible property tokens associated therewith, two or more claim boards, each said claim board being dedicated to a particular player and comprising a miniature representation of said game board, and a set of claim pegs of a number equal to the number of real property spaces on said primary pathway, each said claim peg being associated with a particular real property space and adapted to be placed upon a player's claim board upon acquisition of such real property space by such player to indicate that the property has been acquired.

2. A game board apparatus as set forth in claim 1 wherein at least one of said marked spaces along said primary pathway is designated as an escape area, and said game board includes means depicting a second series of marked spaces defining a plurality of auxiliary pathways extending about said game board between certain of said real property spaces and said escape area, whereby a first player can earn income by absconding with the tangible property tokens owned by other players upon landing on said certain real property spaces owned by such other players and moving his player token and such tangible property tokens from such real property spaces onto and along said auxiliary pathways to said escape area.

3. A game board apparatus as set forth in claim 2 which includes a preselected marked space along said auxiliary pathway and further includes a game of chance, wherein said first player can be penalized if a second player lands upon said (a) marked space (along said auxiliary pathways) upon which said first player is situated before said first player reaches said escape area and said second player wins said (a) game of chance played with said first player.

4. A game board apparatus as set forth in claim 1 (4) which includes a sum of wagerable money, and wherein at least one of said marked spaces along said primary pathway is designated as a power space, and a challenging player whose player token lands thereon is entitled to challenge another player owning real property to a game of chance wherein each player is obligated to wager at least a portion of said sum of money, the player winning said game of chance acquiring ownership of the wagered money.

5. A game board apparatus as set forth in claim 4 further comprising a set of control pegs of a number equal to the number of real property spaces on said primary pathway, each said control peg being associated with a particular real property space and adapted to be placed upon the claim board of said challenging player in accordance with the real property spaces owned by the player losing said game of chance to said challenging player if said challenging player wins said game of chance and the player losing said game of chance cannot tender to said challenging player the amount of said money wagered.

6. A game board apparatus as set forth in claim 1 further comprising one or more specifically designated spaces along said primary pathway and a set of cards, each of said cards (which) enabling (enables) a player to increase or diminish his income or tangible property, a player being obligated to draw one or more of said cards from said set when his player token lands upon one or more of said specifically designated spaces along said primary pathway.

7. A game board apparatus as set forth in claim 1 further comprising a set of cards comprising a game of chance, certain of said cards being winning cards and others of said cards being losing cards, a player having the option to draw one or more of said cards from said set when his player token lands upon one or more of said real property spaces, a player drawing one of said winning cards being entitled to receive income and acquire the real property space upon which his player token has landed if such space is unowned or to receive income only if such space is already owned, and a player drawing one of said losing cards being obligated to forfeit income.

8. A game board apparatus as set forth in claim 1 wherein at least one of said real property spaces is designated as a natural resource space having a natural resource associated therewith, and a player who owns said natural resource space can earn income from said natural resource if his player token lands on said natural resource space and he wins a game of chance.

* * * * *

UNITED STATES PATENT AND TRADEMARK OFFICE

CERTIFICATE OF CORRECTION

PATENT NO. : 4,360,205

DATED : November 23, 1982

INVENTOR(S) : James C. Rimbold

It is certified that error appears in the above-identified patent and that said Letters Patent is hereby corrected as shown below:

Column 1, line 8, "coonstituting" should be --constituting--.

Column 1, line 22, "boarder" should be --border--.

Column 3, line 11, "$b 20" should be --$20--.

Column 3, line 30, "space" should be --spaces--.

Column 4, line 13, "a" should be --an--.

Column 5, line 8, "loss"(first occurrence) should be --lose--.

Column 6, line 28, "covered" should be --colored--.

Column 10, line 39, "maybe" should be --may be--.

Column 14, line 6, 7 "players" should be --plays--.

Column 14, line 64, claim 3, delete "(a)".

Column 14, line 64,65, claim 3, delete "(along said auxiliary pathways)".

Column 14, line 67, claim 3, delete "(a)".

Column 15, line 1, claim 4, delete "(4)".

UNITED STATES PATENT AND TRADEMARK OFFICE

CERTIFICATE OF CORRECTION

PATENT NO. : 4,360,205

DATED : November 23, 1982

INVENTOR(S) : James C. Rimbold

It is certified that error appears in the above-identified patent and that said Letters Patent is hereby corrected as shown below:

Column 15, line 26, claim 6, delete "(which)".

Column 15, line 26, claim 6, delete "(enables)".

Signed and Sealed this

*Twentieth* Day of *March 1984*

[SEAL]

*Attest:*

GERALD J. MOSSINGHOFF

*Attesting Officer*

*Commissioner of Patents and Trademarks*